US007371952B1

(12) United States Patent
Tanaka

(10) Patent No.: US 7,371,952 B1
(45) Date of Patent: May 13, 2008

(54) FRAME STRUCTURE FOR HI-HAT ASSEMBLY

(75) Inventor: Yukio Tanaka, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 11/585,856

(22) Filed: Oct. 25, 2006

(51) Int. Cl.
*G10D 13/02* (2006.01)

(52) U.S. Cl. ..... 84/422.1

(58) Field of Classification Search ..... 84/422.1, 84/422.2, 422.3, 422.4
See application file for complete search history.

(56) References Cited

U.S. PATENT DOCUMENTS

| | | | |
|---|---|---|---|
| 3,464,305 | A | 9/1969 | Meazzi et al. |
| 4,381,690 | A | 5/1983 | Kimble |
| 5,105,706 | A | 4/1992 | Lombardi |
| 5,945,616 | A | 8/1999 | Hoshino |
| 6,075,192 | A | 6/2000 | Hoshino |
| 6,188,007 | B1 * | 2/2001 | Liao ..... 84/422.3 |
| 6,278,046 | B1 | 8/2001 | Sikra et al. |
| 6,307,136 | B1 | 10/2001 | Sikra et al. |
| 6,329,584 | B1 | 12/2001 | Liao |
| 6,399,865 | B1 | 6/2002 | Ishimatsu |
| 6,399,866 | B2 | 6/2002 | Tanaka |
| 6,528,714 | B1 | 3/2003 | Liao |
| 6,822,150 | B1 | 11/2004 | Lombardi |
| 6,982,374 | B2 | 1/2006 | Hsieh |

* cited by examiner

*Primary Examiner*—Kimberly Lockett
(74) *Attorney, Agent, or Firm*—Berenato, White & Stavish

(57) ABSTRACT

A percussion system for a percussion instrument, comprising: a cymbal or other percussion mechanism; an upright elongated support; a base frame from which the support extends upwardly; a drive linking system movable to actuate the sound generating mechanism; and a foot-operated pedal assembly. The pedal assembly actuates the sound generating mechanism through the drive linking system with the pedal assembly being selectively connected to the base frame in one of a play mode or a docking mode. In the play mode, the pedal assembly is connected in a horizontal orientation along a ground surface in which the pedal is adapted to actuate the sound generating mechanism, and in the docking mode the pedal assembly is connected to the base frame in a vertical orientation along the base frame whereby the pedal assembly is connected to a docking station for ease of storage and transport.

14 Claims, 9 Drawing Sheets

FRAME STRUCTURE FOR HI-HAT ASSEMBLY

BACKGROUND OF THE INVENTION a) Field of the Invention

This invention relates generally to improvements in percussion equipment; more particularly, the invention provides an enhanced pedal system having a detachable pedal assembly that may be stored in a docking station to thereby enhance storage and transport of the equipment.

b) Description of Related Art

Current hi-hat systems include a drive chain or strap directly connecting the foot pedal to a vertically movable rod that drives an upper movable cymbal to strike a lower fixed cymbal. Prior art FIGS. 1 and 2 typify such a foot pedal assembly.

The percussion instrument 10 includes multiple, relatively telescoping sections. These include for example upper section 11 telescopically receivable within the lower section 12. A clamp 14 mounted at 15 on the upper section of section 12 is manually operable to clamp a friction ring against the side of section 11, thereby to retain the sections in the position shown. When the clamps are loosened, the sections are relatively telescopically movable from a collapsed position to a desired extended position, as manually controlled by the musician when he or she sets up the equipment.

FIG. 2 also shows two collapsible legs 26 with links 26*a* attached at 27 to ring 25 on the lower section and at 28 to a slide ring 29 slidable axially on the lower section. A clamp 30 clamps the ring to that section. Rings 25 and 29 are rotatable on 12 to selectively position the legs relative to the foot-operated pedal assembly 40 and associated upright posts 52. As will be described in more detail below, a foot pedal assembly is centrally located with respect to the collapsible legs 26. Also schematically shown in FIG. 2 is a lower cymbal 31 attached at 32 to the upper tubular section 11. A vertically movable rod 34 is attached at 35 to a movable, upper cymbal 36. As the rod 34 is drawn in a downward direction by action on the foot pedal assembly 40, the upper cymbal 36 strikes the lower cymbal 31.

This structure of hi-hat cymbal has drawbacks. Because the foot pedal is perpendicularly extended from a foot pedal holder assembly at the bottom side of the center shaft, it tends to be damaged during transportable of the hi-hat cymbal. Further, because the foot pedal mechanism is not collapsible, the hi-hat cymbal occupies much storage space when not in use.

The need therefore exists for a hi-hat cymbal frame whereby the foot pedal mechanism is mounted to the upright stand in a stable manner during use and is mounted to a docking station for storage and transport in a compact arrangement.

SUMMARY OF THE INVENTION

A percussion system for a percussion instrument, comprising: a cymbal or other percussion mechanism; an upright elongated support; a base frame from which the support extends upwardly; a drive linking system movable to actuate the sound generating mechanism; and a foot-operated pedal assembly. The pedal assembly actuates the sound generating mechanism through the drive linking system with the pedal assembly being selectively connected to the base frame in one of a play mode or a docking mode. In the play mode, the pedal assembly is connected to a post clamp in a horizontal orientation along a ground surface in which the pedal is adapted to actuate the sound generating mechanism, and in the docking mode the pedal assembly is connected to a docking station on the upright posts in a vertical orientation along the base frame whereby the pedal assembly is connected to the docking station for ease of storage and transport.

DETAILED DESCRIPTION OF PREFERRED EMBODIMENTS

Figure 1:
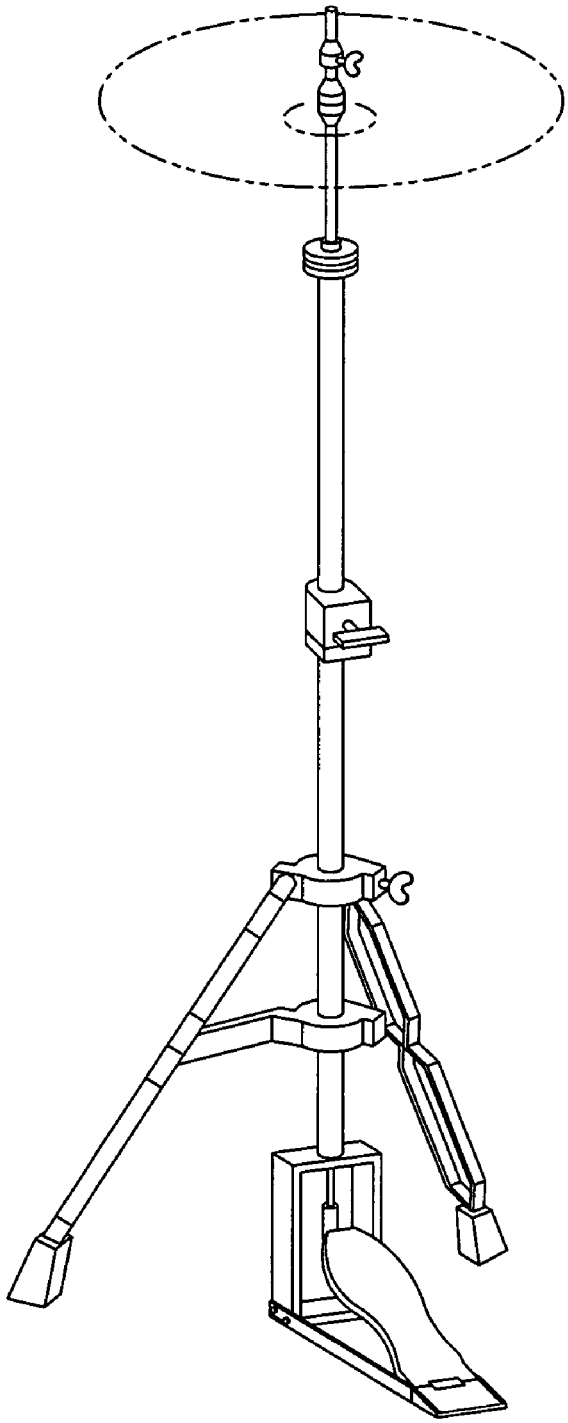
Fig. 1 Prior Art
FIG. 1 is a perspective view of a conventional hi-hat assembly.
Figure 2:
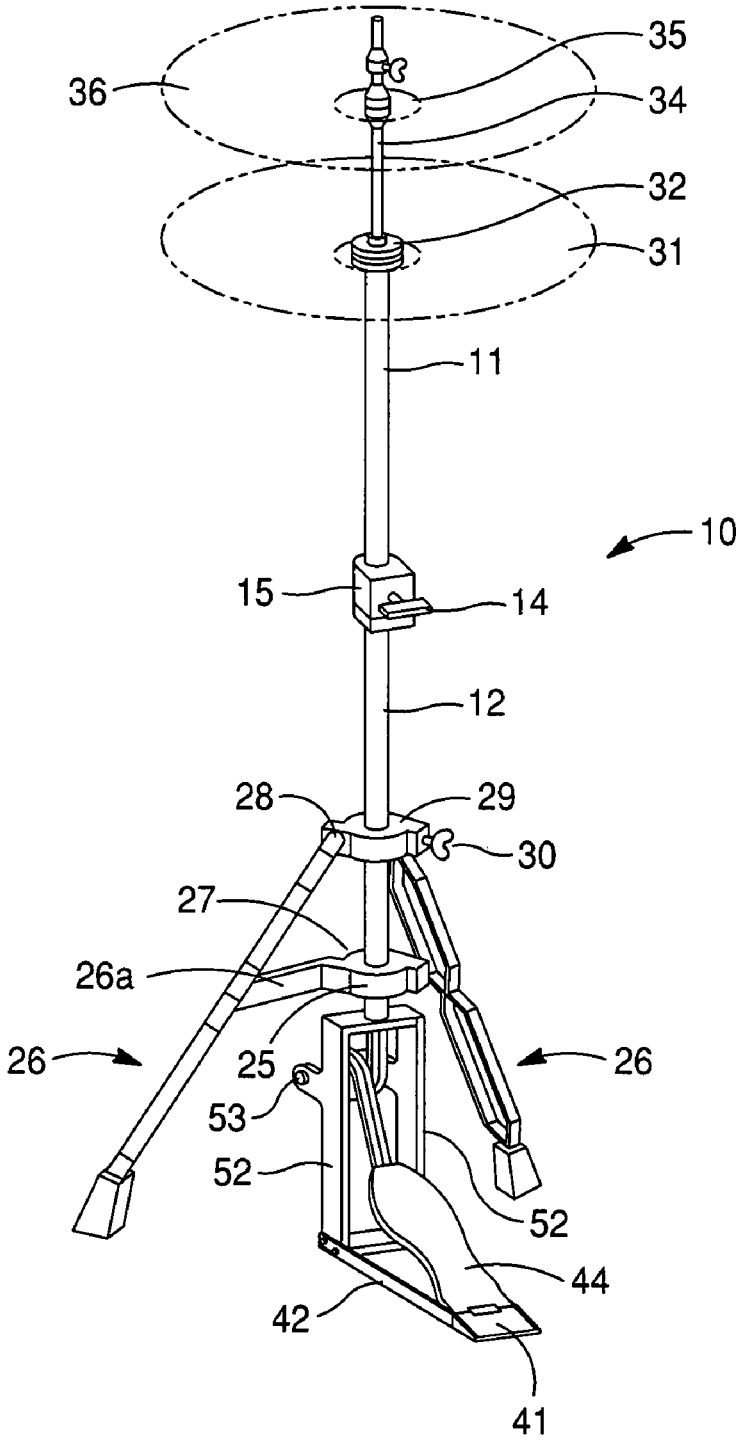
Fig. 2 Prior Art
FIG. 2 is another perspective view of a conventional hi-hat assembly.
Figure 3:
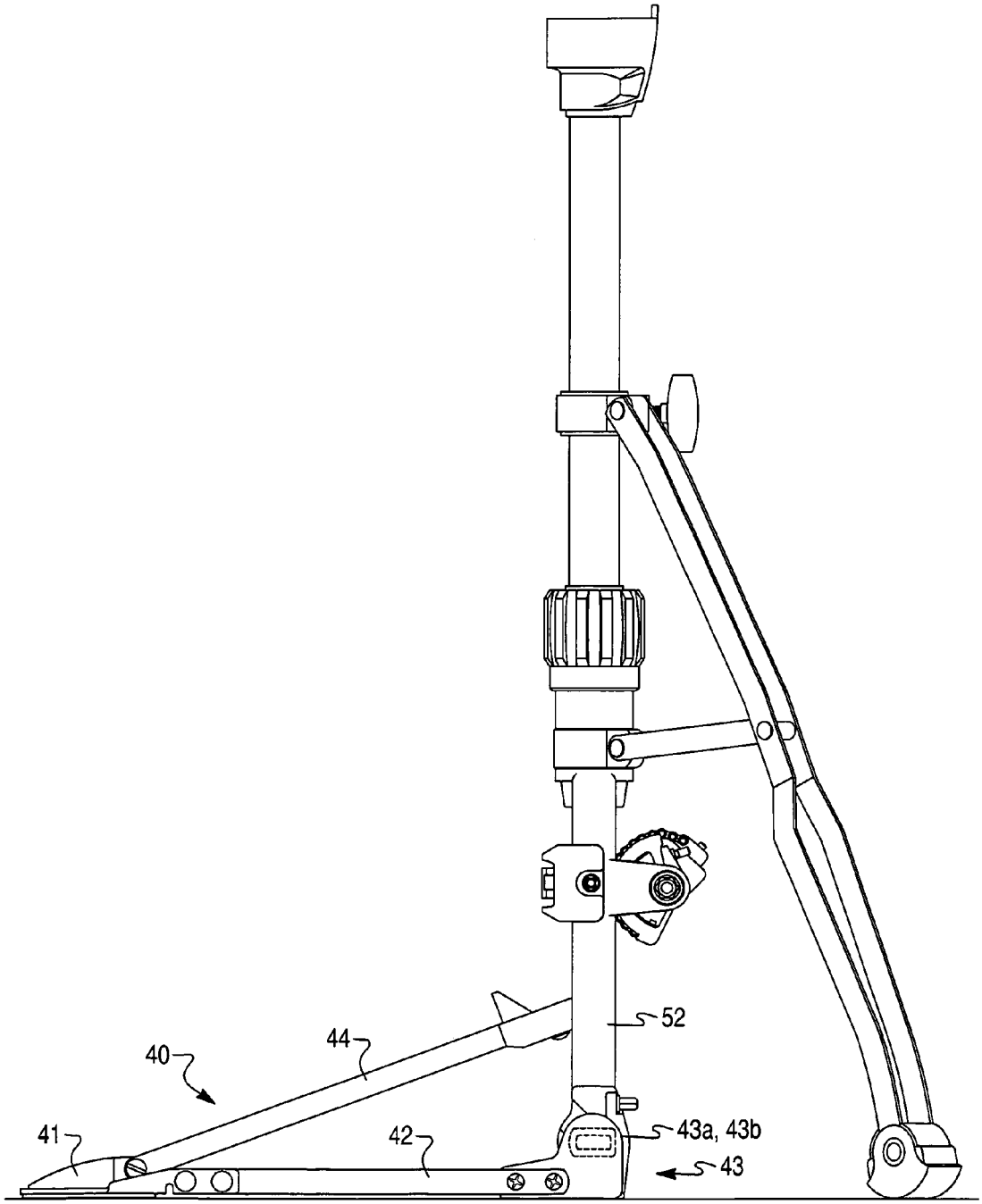
FIG. 3 illustrates a partial cross sectional view of the percussion apparatus instrument incorporating the invention.
Figure 5:
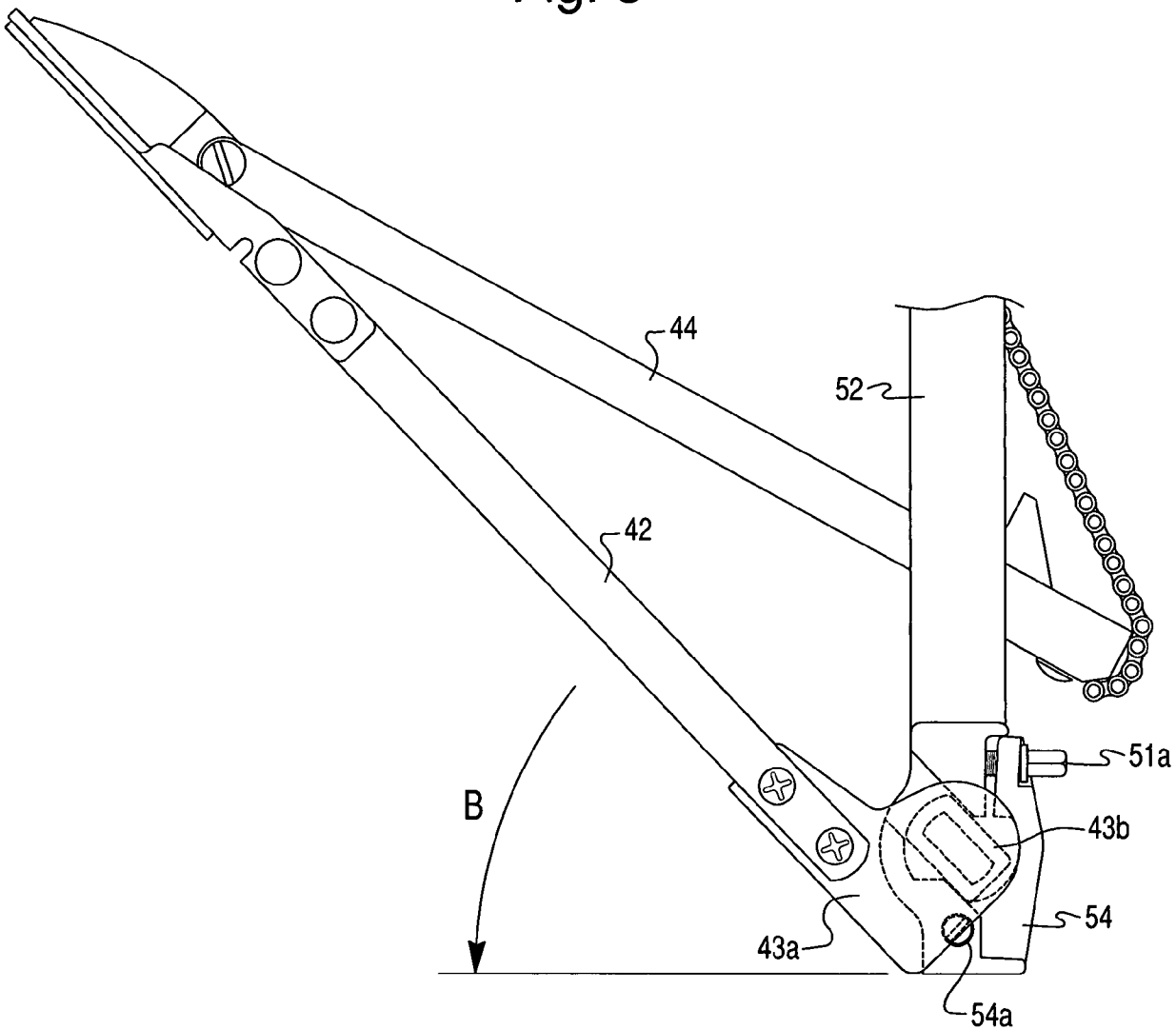
FIG. 5 illustrates the pedal assembly inserted into the post clamp at an angle.
Figure 6:
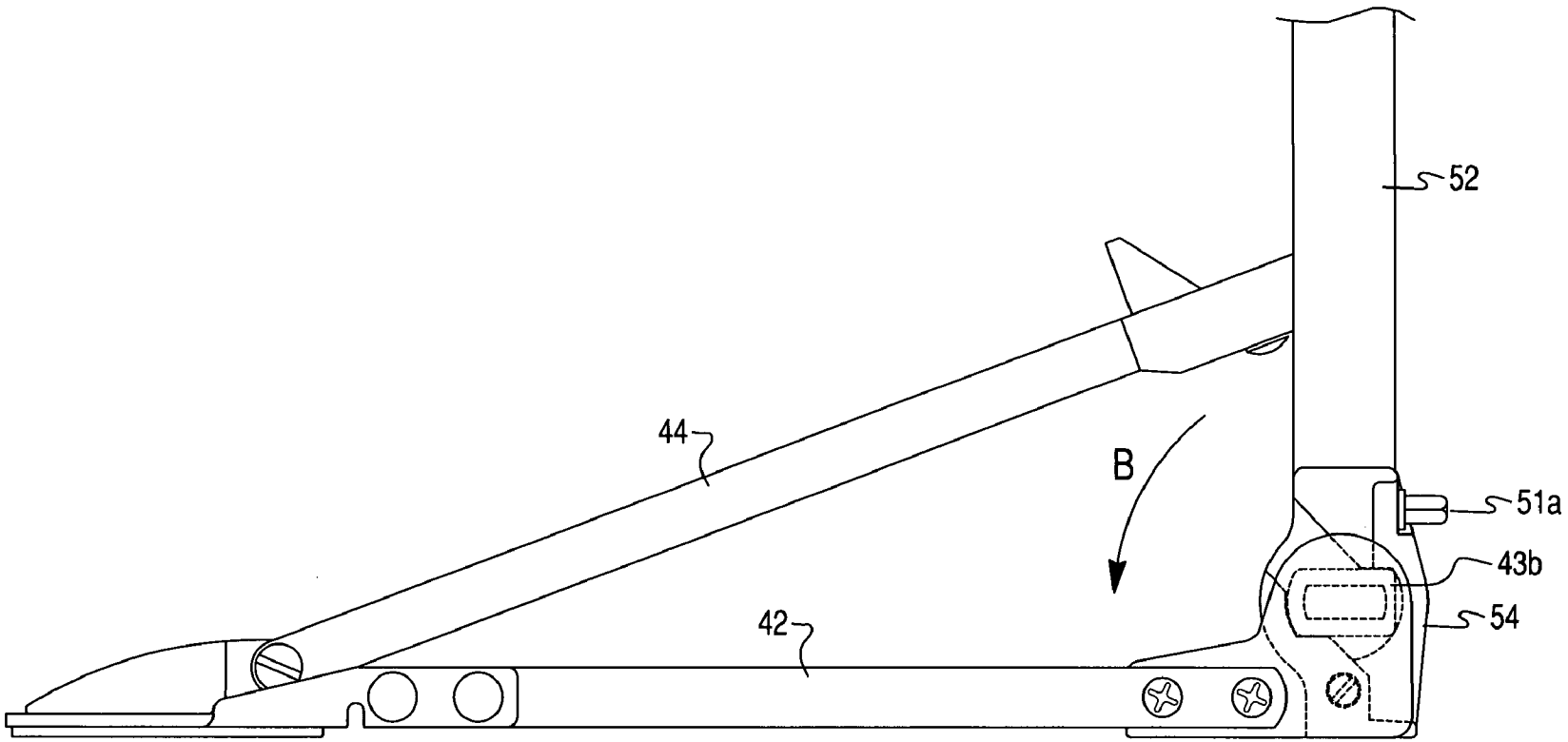
FIG. 6 illustrates the pedal assembly fully inserted into the post clamp and locked in place.

With reference to FIG. 3, the foot-operated pedal assembly 40 illustrated herein includes a pair of forwardly longitudinally elongated struts 42 to which a foot-operated pedal 44 is pivotally attached. Each elongated strut is provided with detachable fastening means 43 at its forward end. The fastening means 43 permits the pedal assembly 40 to be attached/detached from the pair of upright posts 52 through a male-female connector assembly. The fastening means 43 on the pedal assembly consists of forwardly facing hubs 43*a* and inwardly facing tangs 43*b*. The inwardly facing tangs 43*b* engage post clamps 52*a* provided on each upright post 52 by inserting the tangs 43*b* at an angle $\alpha$ in the direction of arrow A then rotated in the direction position shown by arrow B (see FIGS. 4 to 6). The inwardly facing tangs 43*b* are locked in place by rotating the pedal assembly 40 in the direction of arrow B (see FIG. 6) and by tightening the locking screw or nut member 51*a* threadingly disposed on the post clamps 52*a* disposed on upright posts 52. To disassemble the foot-operated pedal assembly 40 from the post clamps 52*a* and upright posts 52, a user loosens the screw or nut member 51*a*, rotates the pedal assembly 40 opposite to the direction of arrow B (FIG. 6) then slides the elongated struts in the rearward direction of arrow A (see FIG. 4) to disengage the inwardly facing tangs 43*b* from the post clamps 52*a*. In this manner, the user pulls the foot-operated pedal assembly 40 away from the post clamps 52*a* to thereby disengage the foot-operated pedal assembly from the post clamps 52*a* and the upright posts 52.

Figure 4:
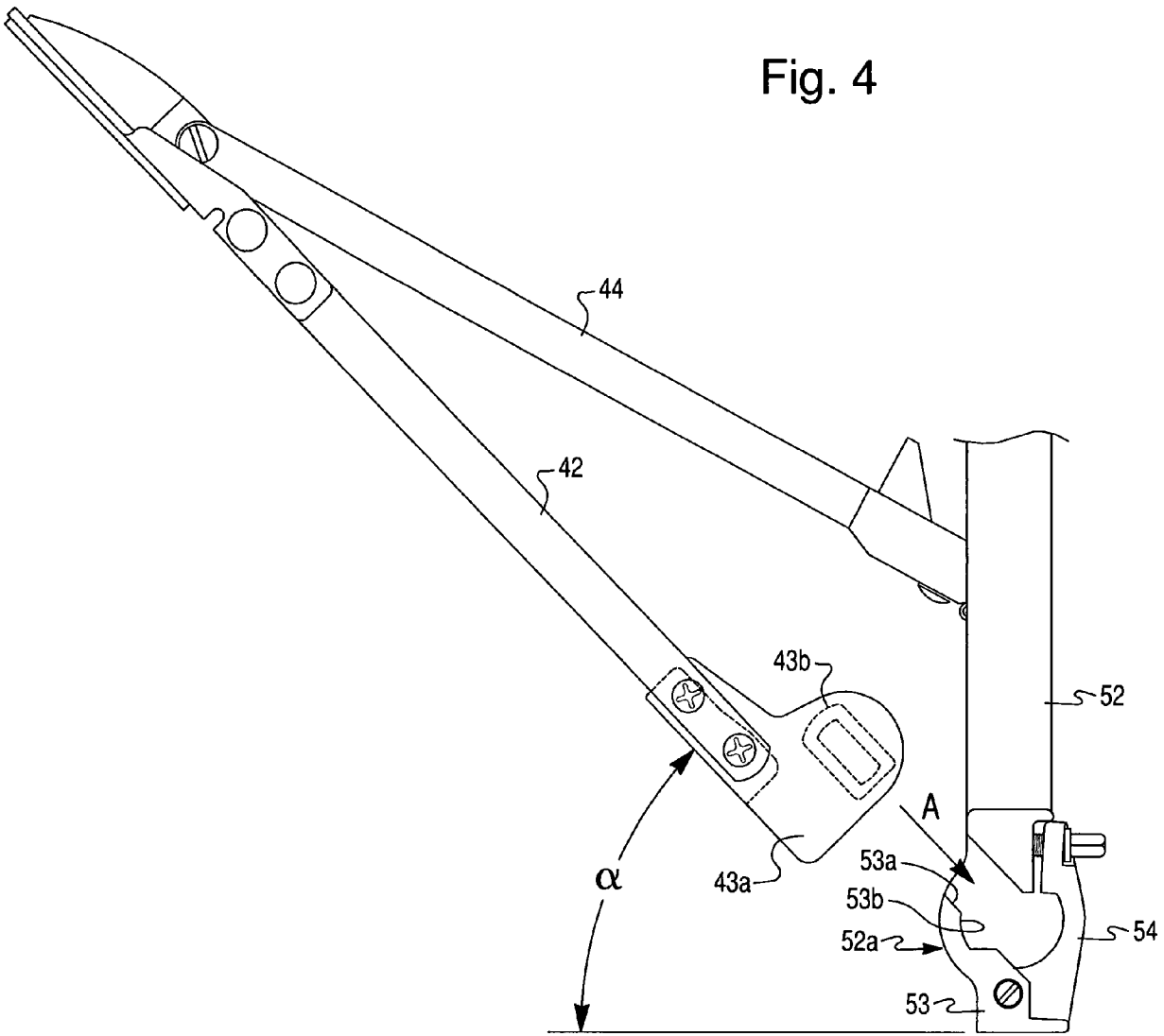
FIG. 4 illustrates an enlarged view of the pedal assembly and one post clamp which consists of a seating portion and clamping portion.

FIG. 4 is an enlarged view of one post clamp 52*a* which consists of a seating portion 53 and clamping portion 54. In the preferred embodiment, each upright post 52 is formed with the post clamp illustrated in FIG. 4. The seating portion 53 is generally formed with a slot 53*a* disposed at an angle α with a locking notch 53*b*. The clamping portion 54 is hinged at one end 54*a* and includes the locking screw 51*a*.

Figure 7:
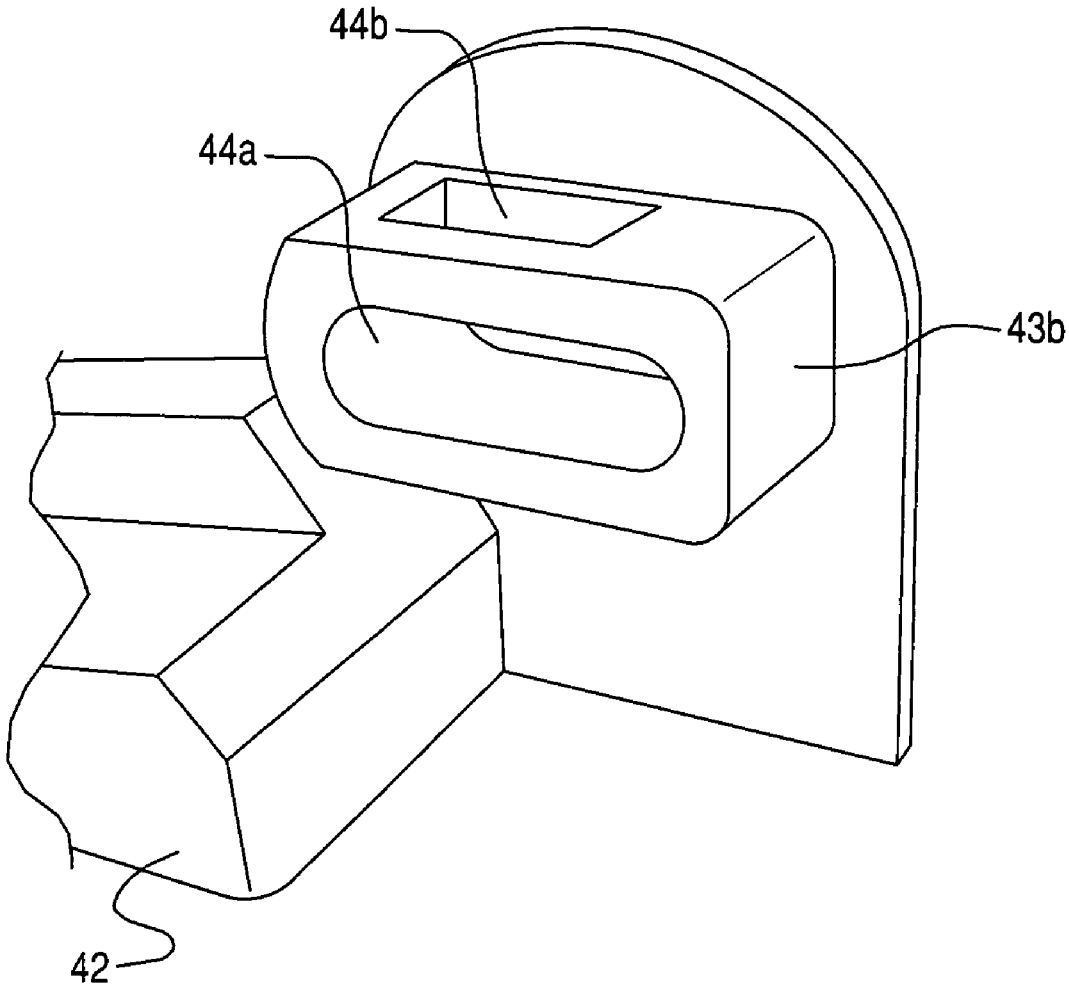
FIG. 7 is an enlarged view of the inwardly facing tang of the fastening means that is disposed on each elongated strut.

FIG. 7 is an enlarged view of the inwardly facing tang 43*b* of the fastening means 43 that is disposed, preferably, on each elongated strut 42. The inwardly facing tangs 43*b* are preferably formed as a rectangular projection with substantially flat sides to keep the stand at 90 degrees relative to the floor or ground surface when the fastening means is disposed in the post clamp(s) 52*a*. Moreover, the inwardly facing tangs 43*b* are formed to alternately be clamped into the docking station in a docking mode as will be described below. To this end, the tangs 43*b* are formed with a hollow inner section 44*a* and an aperture 44*b* in one sidewall for mounting to the docking station.

Figure 8:
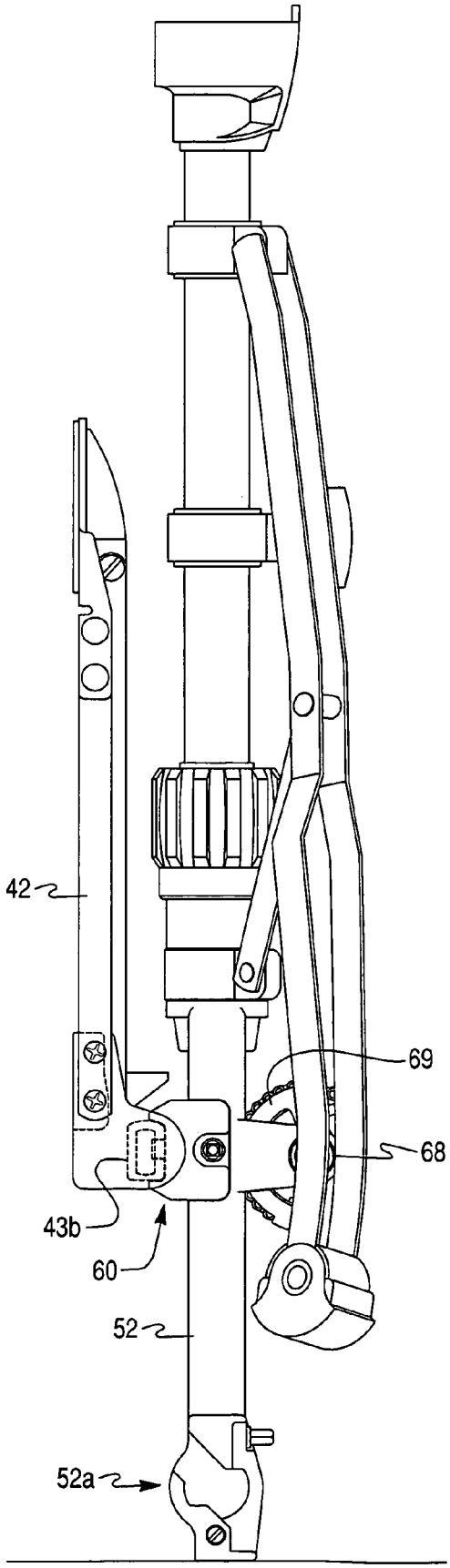
FIG. 8 is a side view of the docking station with the pedal assembly shown in the docking mode.
Figure 9:
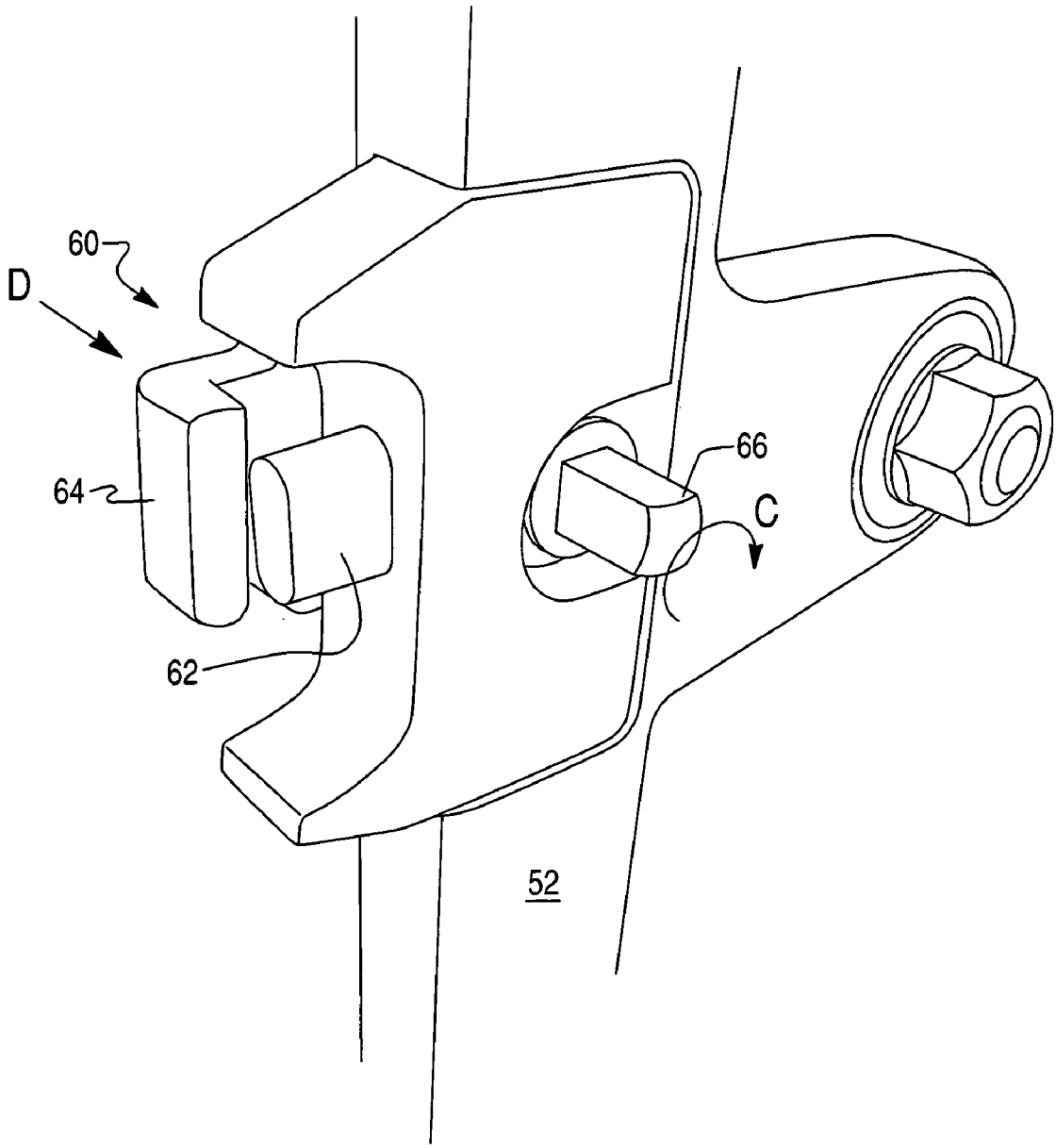
FIG. 9 is an enlarged view of the docking station on the upright post.

FIG. 8 is a side view of the docking station 60 with the pedal assembly 40 shown in the docking mode. The docking station 60 primarily consists of a mounting bracket disposed on the upright posts 52 and having mounting protrusions 62 and fastening brackets 64 to firmly mount the pedal assembly 40 in the docking mode for transport and/or storage. See FIG. 9. More specifically, the pedal assembly 40 is capable of being dislodge from the post clamps 52*a* then docked at the docking station 60 by press-fitting the tangs 43*b* onto the mounting protrusions 62. Specifically, the mounting protrusion 62 is press fit into the aperture 44*b* provided on the inwardly facing tangs 43*b*. Then, the pedal assembly is held in place by tightening the bolt 66 to clamp the pedal assembly 40 to the docking station 60. More specifically, as the bolt 66 is tightened, the fastening brackets 64 are disposed within the hollow inner section 44*a* of the tangs 43*b*, thereby locking the pedal assembly 40 into place on the docking station 60. As the bolt 66 is tightened by turning it in the clockwise direction C (see FIG. 9), the bracket 64 translates in the direction of arrow D (see FIG. 9). The physical interaction of the aperture 44*b* with the mounting protrusion 62 and the hollow inner section 44*a* with the bracket 64 locks the pedal assembly 40 onto the docking station and into the docking mode. By loosening the bolt 66, the pedal assembly 40 is released from the docking station 60.

In the preferred embodiment, the docking station 60 is disposed at a position proximate the pivot shaft 68 and pivot hub 69 for the drive mechanism of the percussion instrument. Such drive mechanisms 68, 69 are known in the art; see for example U.S. Pat. No. 6,399,866 which is incorporated herein by reference. Additionally, it is preferred that the docking station 60 be cast or otherwise integrally formed with the upright legs 52. Of course, it will be understood by those of skill in the art that that docking station 60 may be bolted, screwed, welded or otherwise affixed to the upright legs 52 at a suitable location.

From the foregoing description, it is clear that the present invention provides a unique and effective system for alternately disposing the pedal assembly in a play mode for playing the instrument and/or a docking mode for storage and transportation. It will be understood by those of skill in the art that various changes in form and detail may be made to the preferred embodiments described herein without departing from the spirit and scope of this invention. For example, the exact configuration of the fastening means 43 and post clamps 52*a* may be varied depending on the specific configuration of the instrument, and the specific location and arrangement of the docking station may be varied.

What is claimed is:

1. A percussion system for a percussion instrument with a foot-actuated pedal mechanism, said system comprising:

an upright elongated support;

a base frame from which the support extends upwardly;

a drive linking system movable lengthwise to actuate a sound generating mechanism;

a pedal assembly designed to be actuated by a foot of a user, said pedal assembly actuating said sound generating mechanism through said drive linking system;

said pedal assembly being selectively connected to a first portion of said base frame in a horizontal orientation along a ground surface when connected in a play mode in which said pedal is adapted to actuate said sound generating mechanism and connected to a second portion of said base frame in a vertical orientation along said base frame when connected in a docking mode in which said pedal assembly is connected to a docking station.

2. A percussion system for a percussion instrument with a foot-actuated pedal mechanism, said system comprising:

an upright elongated support;

a base frame from which the support extends upwardly;

a drive linking system movable lengthwise to actuate a sound generating mechanism;

a pedal assembly designed to be actuated by a foot of a user, said pedal assembly actuating said sound generating mechanism through said drive linking system;

said pedal assembly being selectively connected to said base frame in a horizontal orientation along a ground surface when connected in a play mode in which said pedal is adapted to actuate said sound generating mechanism and connected to said base frame in a vertical orientation along said base frame when connected in a docking mode in which said pedal assembly is connected to a docking station, wherein said base frame comprises a pair of vertical legs connected at one end to said support and connected at an opposite end to said pedal assembly through a male-female connector.

3. The percussion system according to claim 2, wherein said base frame and said elongated support are maintained substantially 90 degrees relative to said ground surface in said play mode by said male-female connector.

4. The percussion system according to claim 2, wherein said male-female connector comprises first and second mounting tangs on said pedal assembly and first and second clamps at said opposite end of said vertical legs.

5. The percussion system according to claim 4, wherein each of said first and second mounting tangs are slidingly disposed in said first and second clamps, respectively, and secured by tightening said clamps.

6. The percussion system according to claim 4, wherein said first and second mounting tangs extend from said pedal assembly toward each other.

7. The percussion system according to claim 4, wherein said first and second mounting tangs are inserted into said first and second clamps at an angle, then rotated to a locking position where said clamp is tightened to secure said pedal assembly in said play mode.

8. The percussion system according to claim 2, wherein said base comprises a docking station defined by a bracket disposed on at least one of said pair of vertical legs, said bracket adapted to fixedly secure said pedal assembly to said vertical legs at a location between said one end and said opposite end.

9. The percussion system according to claim 2, wherein said base comprises a docking station defined by a bracket disposed on at least one of said pair of vertical legs, said bracket adapted to fixedly secure said pedal assembly to said vertical legs at a location between said one end and said opposite end.

10. The percussion system according to claim 9, wherein said first and second mounting tangs are adapted to be connected to said docking station and secured to said docking station by a docking clamp in said docking mode.

11. The percussion system according to claim 8, wherein said pedal assembly remains connected to said drive link system in both said play mode and said docking mode.

12. The percussion system according to claim 8, wherein said pedal assembly comprises a pair of horizontal struts with a foot board pivotally connected to said horizontal struts at a distal end and with mounting tangs fixed to said horizontal struts at a proximate end, said mounting tangs affixed to said bracket in said docking mode.

13. The percussion system according to claim 12, wherein said pedal assembly projects upwardly from said docking station along said elongated support in a compact manner with said distal end being above said proximate end in said docking mode.

14. A frame structure for a percussion instrument, comprising:

a base frame including a first and second mounting bracket;

a drive linking system movable lengthwise to actuate a sound generating mechanism;

a pedal assembly designed to be actuated by a foot of a user to drive said linking system, said pedal assembly comprising a horizontal base with a foot board pivotally connected to said horizontal base at a distal end and with a mounting member fixed to said horizontal struts at a proximate end, said mounting member being selectively connected to said first mounting bracket of said base frame in a horizontal orientation along a ground surface when connected in a play mode in which said pedal is adapted to actuate said sound generating mechanism and removed from said first mounting bracket and connected to said second mounting bracket of said base frame in a vertical orientation along said base frame when connected in a docking mode for ease of storage and transport.

* * * * *